US006579116B2

(12) United States Patent
Brennan et al.

(10) Patent No.: US 6,579,116 B2
(45) Date of Patent: Jun. 17, 2003

(54) HIGH SPEED MODULAR CONNECTOR

(75) Inventors: Robert J. Brennan, York, PA (US); Randy K. Schwartz, York, PA (US); Justin S. Wagner, York, PA (US)

(73) Assignee: Sentinel Holding, Inc., York, PA (US)

( * ) Notice: Subject to any disclaimer, the term of this patent is extended or adjusted under 35 U.S.C. 154(b) by 0 days.

(21) Appl. No.: 09/804,435

(22) Filed: Mar. 12, 2001

(65) Prior Publication Data

US 2003/0096529 A1 May 22, 2003

(51) Int. Cl.[7] ..... H01R 4/26

(52) U.S. Cl. ..... 439/418; 439/676; 439/941; 439/90

(58) Field of Search ..... 439/418, 460, 439/676, 941, 942, 188, 90, 88, 417, 344

(56) References Cited

U.S. PATENT DOCUMENTS

| | | | | |
|---|---|---|---|---|
| 4,339,490 A | | 7/1982 | Yoshioka et al. | 428/213 |
| 4,601,530 A | | 7/1986 | Coldren et al. | 339/103 M |
| 4,713,023 A | | 12/1987 | Bixler et al. | 439/393 |
| 4,767,355 A | | 8/1988 | Phillipson et al. | 439/425 |
| 4,975,078 A | | 12/1990 | Stroede et al. | 439/405 |
| 5,186,647 A | | 2/1993 | Denkmann et al. | 439/395 |
| 5,194,014 A | | 3/1993 | McClune et al. | 439/404 |
| 5,431,584 A | | 7/1995 | Ferry | 439/620 |
| 5,456,619 A | | 10/1995 | Belopolsky et al. | 439/620 |
| 5,538,784 A | | 7/1996 | Subramanian | 428/283 |
| 5,571,035 A | | 11/1996 | Ferrill | 439/894 |
| 5,592,739 A | | 1/1997 | Ferrill et al. | 29/872 |
| 5,599,209 A | | 2/1997 | Belopolsky | 439/676 |
| 5,605,469 A | | 2/1997 | Wellinsky et al. | 439/417 |
| 5,628,647 A | | 5/1997 | Rohrbaugh et al. | 439/404 |
| 5,647,770 A | | 7/1997 | Beloposky | 439/676 |
| 5,687,478 A | | 11/1997 | Beloposky | 29/884 |
| 5,759,070 A | | 6/1998 | Beloposky | 439/676 |
| 5,791,942 A | | 8/1998 | Patel | 439/637 |
| 5,791,943 A | | 8/1998 | Lo et al. | 439/676 |
| 5,830,005 A | | 11/1998 | Watanabe | 439/418 |
| 5,885,111 A | | 3/1999 | Yu | 439/676 |
| 5,899,770 A | * | 5/1999 | Ezawa | 439/418 |
| 5,938,479 A | | 8/1999 | Paulson et al. | 439/676 |
| 5,967,801 A | | 10/1999 | Martin et al. | 439/76.1 |
| 5,989,071 A | | 11/1999 | Larsen et al. | 439/676 |
| 6,019,641 A | | 2/2000 | Kan | 439/676 |
| 6,045,389 A | | 4/2000 | Ferrill et al. | 439/398 |
| 6,051,307 A | | 4/2000 | Kido et al. | 428/297.4 |
| 6,080,007 A | * | 6/2000 | Dupuis et al. | 439/418 |
| 6,083,052 A | | 7/2000 | Adams et al. | 439/676 |
| 6,086,428 A | | 7/2000 | Pharney et al. | 439/676 |
| 6,113,400 A | | 9/2000 | Martin et al. | 439/76.1 |
| 6,116,943 A | | 9/2000 | Ferrill et al. | 439/418 |
| 6,116,964 A | | 9/2000 | Goodrich et al. | 439/676 |
| 6,126,476 A | | 10/2000 | Viklund et al. | 439/404 |
| 6,155,881 A | | 12/2000 | Arnett et al. | 439/676 |
| 6,280,232 B1 | * | 8/2001 | Beecher et al. | 439/418 |

OTHER PUBLICATIONS

Larry Rupprecht, "Shielding with Thermoplastic Compounds," Evaluation Engineering, Nov. 2000 issue, pp. 124, 126, 128 and 130.

* cited by examiner

*Primary Examiner*—Jean F. Duverne
(74) *Attorney, Agent, or Firm*—Hooker & Habib, P.C.

(57) ABSTRACT

Modular plugs and jacks connect data signal transmission cables to computer components are provided with cross-talk reducing members surrounding or between parallel or near parallel sections of conductors in the plugs and jacks. Each cross-talk reducing member includes a dielectric body surrounding an irregular three dimensional conductive lattice made of a plurality of straight conductive carbon fiber rods. The lattice reduces cross-talk between signal conductors in the plugs and jacks.

40 Claims, 11 Drawing Sheets

HIGH SPEED MODULAR CONNECTOR

FIELD OF THE INVENTION

The invention relates to modular plugs and modular jacks used for forming electrical connections between multi-conductor signal transmission cables and computer components.

DESCRIPTION OF THE PRIOR ART

Multi-conductor cables are used for transmitting high speed electronic signals between computer components. Multi-contact plugs are mounted on the ends of the cables and removably engage multi-contact jacks mounted on computer components to establish electrical connections between the components. The Federal Communication Commission established physical shape and contact spacing standards for modular plugs and modular jacks used for transmitting analog telephone signals. The FCC standards have not changed appreciably and now govern plugs and jacks used for transmitting digital signals despite requirements that the plugs find jacks have low digital signal cross-talk.

ANSI/TIA/EIA Category 6 performance standards govern modular plugs and jacks used to carry digital signals at frequencies as high as 250 MHZ. Category 6 standards include minimum levels of permissible cross-talk generated between conductors in the plugs and jacks. Increased signal frequency increases the difficulty in reducing cross-talk in modular plugs and jacks because the small size and shape of the plugs and jacks requires close placement of the conductors.

Reduction of cross-talk is further complicated by the necessity that the plugs and jacks must be inexpensive and must be assembled with minimum labor cost. Mounting a small modular plug body on the eight wires at the end of a twisted pair signal transmission cable is difficult and time consuming. Insertion of the ends of insulated cable wires into proper wire passages in the dielectric plug body is facilitated by extending the wire ends through passages formed in a plastic load bar outside the plug in order to orient the wires properly for extension into the passages in the front of the plug body. The passages in the load bar are arraigned in the same pattern as the wire passages in the plug body. The load bar and oriented wire ends may then be extended into the plug body with assurance that the wire ends will be extended into proper wire passages in the plug body. After insertion, blade contacts are driven down through slots in the body to engage the wire ends in the wire passages.

Use of a load bar facilitates manual assembly of modular plugs. However, the load bar orients the cable signal wires extending through the load bar parallel to each, other. This orientation induces cross-talk between the wires in the load bar, particularly when the wires transmit high frequency signals.

Modular jacks include molded dielectric bodies which support shaped wire conductors. The conductors have cantilever contact ends extending into a plug cavity for forming electrical connections with the blade contacts of a modular plug inserted into the cavity. The conductors away from the plug cavity run parallel or nearly parallel to each other to contact legs which extend outwardly from the body and are soldered to a circuit board. The parallel or near parallel portions of the conductors in the plug generate cross-talk, particularly when transmitting high frequency signals.

Accordingly, there is a need for reducing cross-talk between closely spaced parallel or nearly parallel conductors in modular plugs and jacks. Preferably, cross-talk should be reduced to meet or exceed Category 6 cross-talk standards. A plug connector should preferably include a load bare to facilitate proper orientation of the ends of insulated wires in the transmission cable for proper insertion in wire passages in the plug body. The bar should reduce cross-talk, between the insulated wires extending past the bar. Preferably, the jack should reduce cross-talk despite conductors running parallel to or nearly parallel to each other between the cantilever contacts and the contact legs and the production cost of the bar should be low but still provide high quality cross-talk reductions meeting or exceeding Category 6 cross-talk standards. The plugs and jacks should be less expensive than conventional cross-talk reducing plugs and jacks.

Accordingly, there is a need for reducing cross-talk between closely spaced parallel or nearly parallel conductors in modular plugs and jacks. Preferably, cross-talk should be reduced to meet or exceed Category 6 cross-talk standards. A plug connector should preferably include a load bar to facilitate proper orientation of the ends of insulated wires in the transmission cable for proper insertion in wire passages in the plug body. The bar should reduce cross-talk between the insulated wires extending past the bar. Preferably, the jack should reduce cross-talk despite conductors running parallel to or nearly parallel to each other between the cantilever contacts and the contact legs.

SUMMARY OF THE INVENTION

The invention is directed to an improved, inexpensive modular connecter, either a modular plug or jack, used for forming connections between high frequency computer signal transmission cables and computer components where signal transmission wires or conductors in the plug or jack extend through or to either side of a cross-talk reducing bar or member having a molded dielectric plastic body with an imbedded irregular three dimensional spaced lattice of small diameter conductive rods. The lattice absorbs radio frequency signals between the conductors or wires extending through or to either side of the bar to reduce cross-talk.

The invention is directed to an improved modular connecter, either a modular plug or jack, used for forming connections between high frequency computer signal transmission cables and computer components where signal transmission wires or conductors in the plug or jack extend through or to either side of a cross-talk reducing bar or member having a molded dielectric plastic body with an imbedded irregular three dimensional spaced lattice of small diameter conductive rods. The lattice absorbs radio frequency signals between the conductors or wires extending through or to either side of the bar to reduce cross-talk.

The lattice may be formed from a large number of small diameter conductive carbon fiber rods mixed into a dielectric plastic body prior to injection molding. The elongate fibers contact each other throughout the plastic body to form a irregularly shaped three dimensional conductive lattice extending throughout the body and located between signal conductors or wires. Radio frequency cross-talk signals are absorbed on the lattice within the dielectric body and dissipated in the body to reduce cross-talk between the conductors. The bar is mounted in the plug or jack and is electrically isolated from ground or other electrical potential. Cross-talk radiation absorbed on the lattice does not generate a current which must be drained from the lattice.

The invention is also directed to a cross-talk reducing member including a dielectric body with a lattice of conductive radiation absorbing elements distributed substantially uniformly throughout the body. The member is positioned between signal conductors. The radiation absorbing elements in the body absorb radiation and reduce cross-talk between conductors.

Other objects and features of the invention will become apparent as the description proceeds, especially when taken in conjunction with the accompanying drawings illustrating the invention, of which there are eleven sheets of drawings and eight embodiments.

DESCRIPTION OF THE PREFERRED EMBODIMENT

Figure 1:
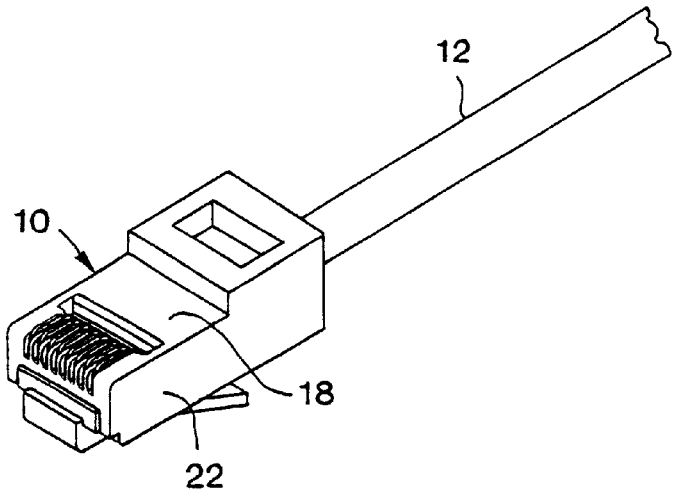
FIG. 1 is a perspective view of a first embodiment modular plug mounted on one end of an eight wire transmission cable.

High-speed modular plug 10 is adapted to be mounted on one end of an eight conductor data transmission cable 12 used for transmitting computer signals between spaced computer components. The plug includes a dielectric body 14 preferably molded from thermoplastic resin which may be polycarbonate or polyester. The body has a front face 16, top side 18, bottom side 20, right side 22, left side 24 and rear face 26. Cable recess 28 opens into the rear face of the body and extends forwardly to front recess wall 30 located inwardly from front face 16. The recess includes a top wall 32, bottom wall 34 and right and left side walls (not illustrated) located inwardly of right and left body sides 22 and 24.

Eight parallel wire passages 36 (only one illustrated) extend forwardly into the body from the front recess wall 30 for receiving the ends of the eight insulated wires in cable 12. Eight blade contacts 38 are inserted into slots formed in the top side 18 of body 14 adjacent front face 16. Pierce tines on the lower ends of the contacts extend into and establish electrical connections with the central conductors of the wires in passages 36. The upper ends of the blade contacts 38 engage contacts in the modular jack with Which plug 10 is mated to form electrical connections between the wires in the cable and a circuit member supporting the jack.

Figure 2:
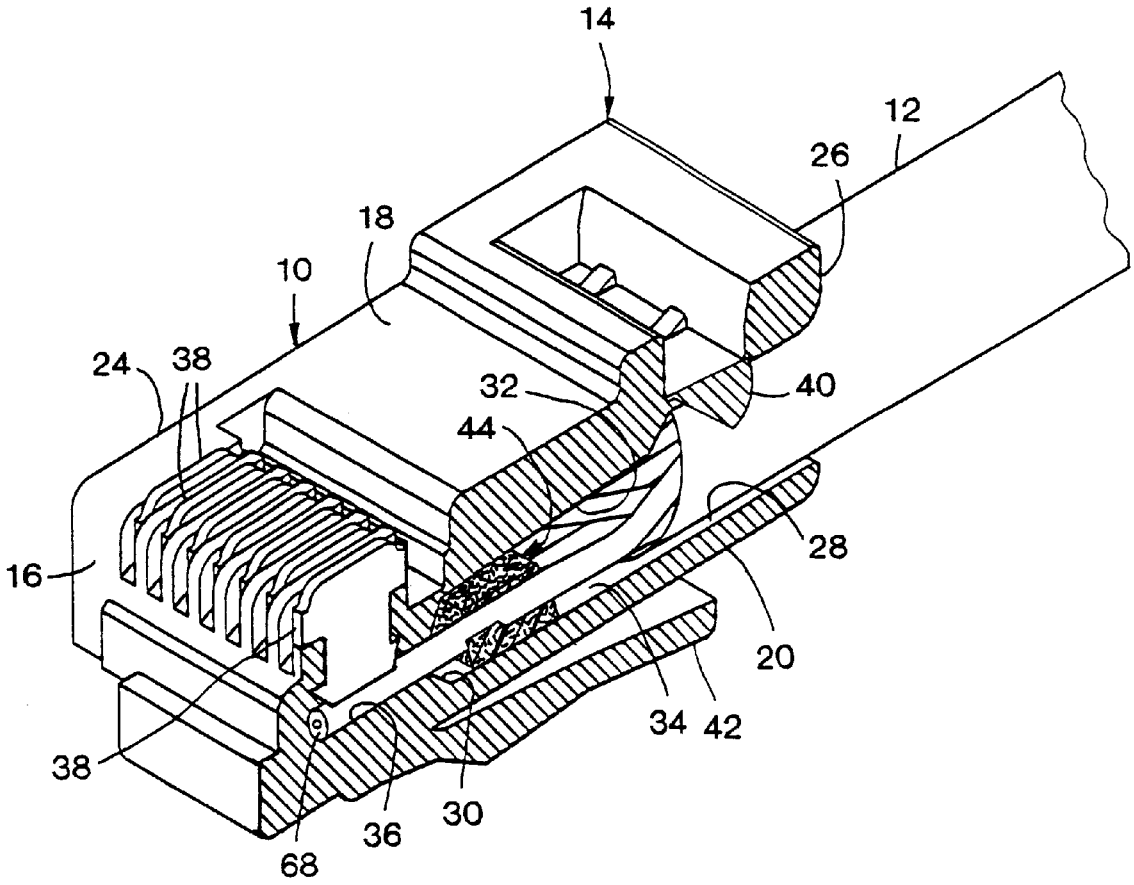
FIG. 2 is a sectional view through the plug mounted on the end of the cable.

Body 14 includes an integral cable clamp 40, which is locked in a lowered position shown in FIG. 2 to secure the end of cable 12 in recess 28. Body 14 also includes a flexible snap latch 42 mounted on bottom side 20 for releasably engaging the plug in a modular jack.

Cross-talk-reducing bar or member 44 is positioned in the inner end of cable recess 28 adjacent front wall 30. The bar 44 has an elongate rectangular or block shape with a front face 46, top side 48, bottom side 50, right side 52, left side 54 and rear face 56. Wire cavity 58 opens into bar 44 from rear face 56 and extends into the bar approximately half way to front face 46. Collar 59 extends around cavity 58. Eight parallel closed wire passages or holes 60 extend from the wire cavity to the front face. Wire guide walls 66 extend inwardly from the collar between passages 60 to aid in inserting wires into the passages. Bar 44 is placed in the bottom of the cable recess 28 in modular plug 10. The bar may have a length between sides 52 and 54 of 0.380 inches, a height between bottom side 50 and top side 48 of 0.110 inches and a depth between front face 46 and rear face 56 of 0.150 inches. Passages 60 have a diameter of 0.044 inches and a length, extending from front face 46 to wire cavity 58, of about 0.055 inches. The minimum distance between adjacent wire passages 60 is about 0.008 inches.

Figure 5:
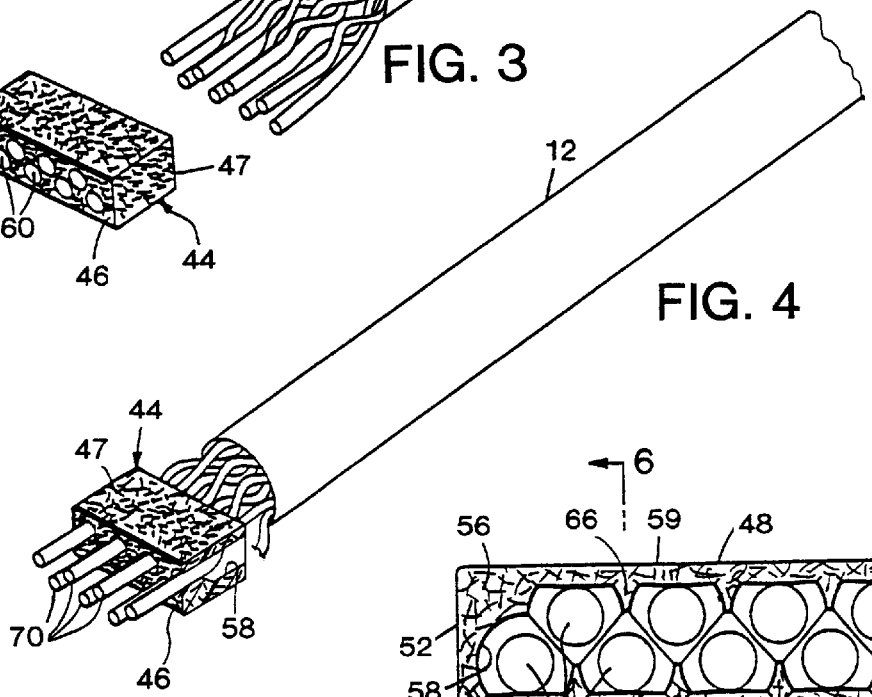
FIG. 5 is a rear view of the bar.
Figure 5:
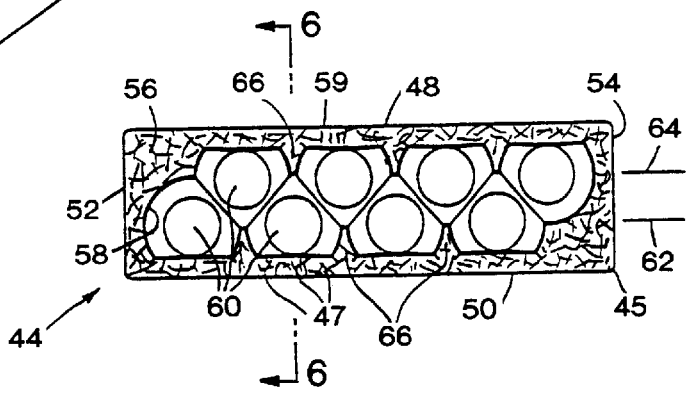
Figure 6:
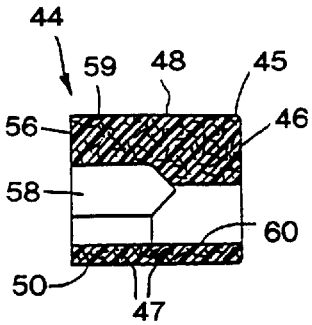
FIG. 6 is a sectional view taken along line 6—6 of FIG. 5.

As illustrated in FIG. 5, the axes of four passages 60 lie in a lower plane 62 and the axes of the four upper passages 60 lie in an upper plane 64, with the passages staggered between the planes across the length of the bar between sides 52 and 54. Wire passages 36 in body 14 align with wire 60 passages in bar 44 when the bar is snuggly fitted in the front end of the cable recess 28 as illustrated in FIG. 2.

The cross-talk reducing bar 44 includes a molded plastic body 45 which is filled with a large number of small diameter, straight carbon fiber rods 47. The rods are electrically conductive and are distributed essential uniformly throughout body 45 in random orientation. The rods contact each other throughout the body to form an irregular three dimensional conductive lattice extending throughout the body. The rods form straight, conductive lattice segments. Because the fibers are randomly oriented throughout plastic body 45 the lattice has an irregular three dimensional shape made up of many interconnected straight segments extending throughout body 45. The lattice of carbon fiber rods in body 45 extends around each of the wire passages 60 to separate each passage from adjacent passages. The carbon fibers may have a diameter as small as about 0.0002 inches.

The bar 44 is injection molded using resin pellets filled with carbon fiber rods. One-fourth inch long carbon fiber rods are mixed with molten dielectric resin and are extruded to form the pellets. During this process the carbon fiber rods are broken into shorter segments. The pellets are heated and extruded during manufacture of bar 44. This process is believed to further shorten the length of the carbon fiber rods in the bars. The lengths of the rods in the bar is not known. The different lengths of the rods in body 45 is believed to increase the number of contacts between adjacent rods, increase the conductivity of the lattice and improve absorption of cross-talk by the lattice.

Bar 44 is molded from resin pellets filled with carbon fiber rods. The pellets are manufactured by the General Electric Company, Product identifier SML 5857. Carbon fiber filled polycarbonate and polyester pellets are available.

The carbon fiber rods 47 in bar 44 may constitute from 10 to 35 percent of the weight of the bar. A higher concentration of carbon rods increases the ability of the bar to reduce or attenuate cross-talk between conductors.

Figure 3:
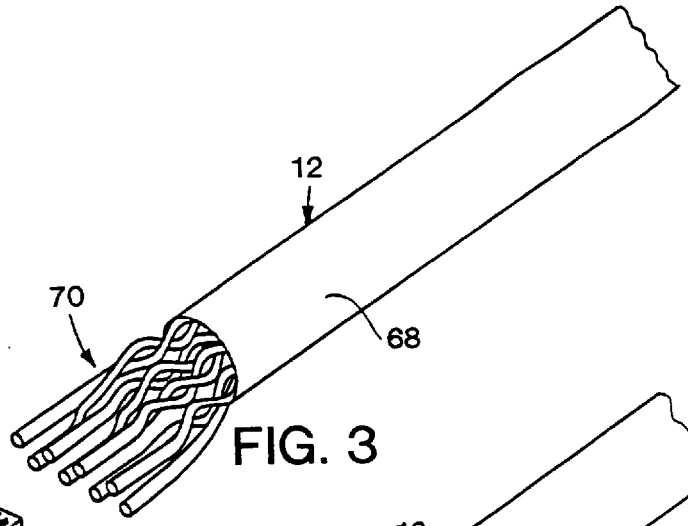
FIG. 3 illustrates the end of the cable with fanned wires in position to be extended through passages in a cross-talk-reducing bar.
Figure 4:
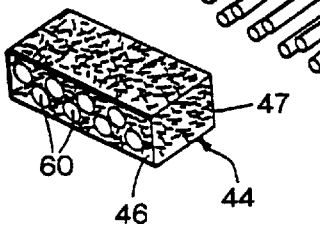
FIG. 4 illustrates the bar mounted on the wires with one wire and a portion of the bar broken away.

FIG. 3 illustrates that cable 12 includes a cylindrical dielectric sheath 68, which surrounds four twisted pairs of insulated wires 70. In order to mount the plug on the end of cable 12 it is necessary to strip back the sheath from the end of the cable to expose the ends of the wires and to unwind, straighten and fan the ends of the wires as shown in FIG. 3. Each wire end is appropriately aligned to be extended into the wire cavity 58 of bar 44 and from the wire cavity into the appropriate passage 60 in the bar. FIG. 4 illustrates the position of the bar with the ends of the insulated wires 70 each extending through wire passage 60 and outwardly from the passage beyond bar front face 46.

With bar 44 mounted on the ends of the wires 70 as shown in FIG. 4 the end of the cable and bar 44 are extended into the cable recess 28 of plug body 14. The aligned front ends of insulated wires 70 are guided into their respective wire passages 36 which are aligned with passages 60 in the bar. Blade contacts 38 are then inserted into vertical slots extending from the plug top side 18 to the wire passages 36 to pierce the insulation in the wires and form electrical connections with the conductors in the wires, as illustrated in FIG. 2. The cable clamp 40 is then depressed to secure the cable in place in body 14. Bar 44 arranges the wires in passages 60 in straight, parallel runs which can generate cross-talk between adjacent signal carrying pairs of wires.

Bar 44 absorbs cross-talk generated in plug 10. Electromagnetic cross-talk radiation is caused by high frequency signals transmitted through pairs of signal wires 70 passing through bar 44. The carbon fiber lattice in bar 44 surrounds each wire 70 extending through the body for approximately one-half the width of the bar, as shown in FIG. 4. The circumferential lattice portions are believed to efficiently absorb and dissipate cross-talk between signal wire pairs. Collar 59 and guide walls 66 are believed to assist in reducing cross-talk.

Use of bar 44 with a carbon fiber lattice formed of rods 47 permits operators to quickly extend the wires 70 at the end of a cable through the bar in proper orientation for extension into body 14 and reduce cross-talk from the resultant parallel portions or runs of the pairs at signal wires in the bar.

The efficiency of the bar in reducing cross-talk was unexpected. Tests of a modular plug with a solid brass load bar, having the same shape as a conventional molded plastic load bar, but without a wire recess in the rear face of the load bar, showed that the metal load bar reduced cross talk between pairs of signal wires extending through wire passages in the load bar and could meet Category 6 cross-talk standards.

Testing of a modular plug with a load bar with a dielectric body surrounding the described irregular three dimensional conductive lattice determined that the load bar was more efficient in decreasing cross-talk than the solid brass load bar, despite the fact the electrical resistance of the brass load bar, as measured between the right and left sides of the load bar, was considerably less than the electrical resistance of the plastic load bar with the embedded irregular conductive lattice, as measured between the same right and left sides. A modular plug with a ferrite load bar was also tested to determine the ability of the ferrite bar to reduce cross-talk generated by high frequency Category 6 signals. The ferrite bar did not reduce cross-talk, and was less efficient in reducing cross-talk than a conventional molded plastic load bar without a carbon fiber rod lattice.

The plastic load bar with embedded lattice is believed to be efficient in reducing cross-talk between wires because electromagnetic cross-talk radiation is absorbed on the irregular length rods making up the lattice and is dissipated along the lattice within the dielectric body. Absorption and dissipation of electromagnetic radiation on the large area of the irregular, three dimensional conductive lattice is believed to be more efficient than absorption of electromagnetic radiation by a solid conductive metal bar where, due to the skin effect, radiation is absorbed on the relatively small surface area of the bar.

The cross-talk attenuation achieved by bar 44 depends on the density of the carbon fiber rods in the body. A prototype plug used a bar with a polycarbonate body 45 filled with an internal irregular three dimensional lattice of carbon fiber rods as described with the rods constituting 20 percent by weight of the bar. The plug was tested to determine cross-talk reduction and was found to meet lower level Category 6 cross-talk attenuation standards.

In another test, a plug using a polycarbonate bar filled with 35 percent by weight carbon fiber rods was found to attenuate cross-talk more efficiently than the plug with the 20 percent by weight carbon fiber rods and to exceed Category 6 cross-talk attenuation standards.

A further test was conducted using a plug with a bar molded from polyester with 30 percent by weight carbon fiber rods. This plug reduced cross-talk, but was not as efficient in reducing cross-talk as the plug with a polycarbonate body and 20 percent per weight carbon fiber rods.

In plug 10, the insulation on wires 70 prevents the conductors in the wires from contacting the bars. The bars engage the inner surface of the cable recess in the body and are electrically isolated from the signals transmitted through the plug and adjacent circuitry. The bars are not grounded.

Cross-talk reducing bar or member 44 is molded as a separate part prior to extension of wires 70 through passages 60 in the bar. If desired, the wires 70 may be positioned in a mold in appropriate staggered relation in two planes, like planes 62 and 64, and the bar may be over-molded around the wires with the lead ends of the wires extending outwardly from the bar and away from, cable 12. The over-molded bar and wires are inserted into plug body 14 as described. The over-molded bar reduces cross-talk as described.

Figure 7:
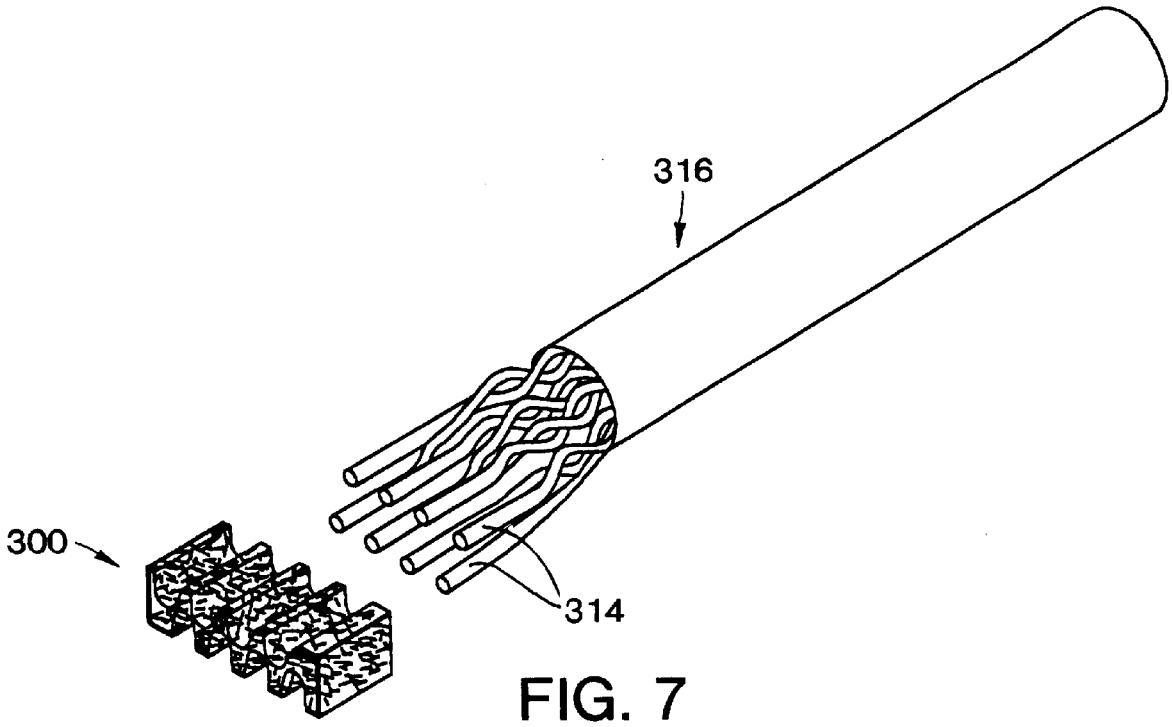
FIG. 7 is a perspective view like FIG. 3 illustrating the end of a cable with fanned wires in position to be extended through open passages or grooves in a second embodiment cross-talk reducing bar.
Figure 8:
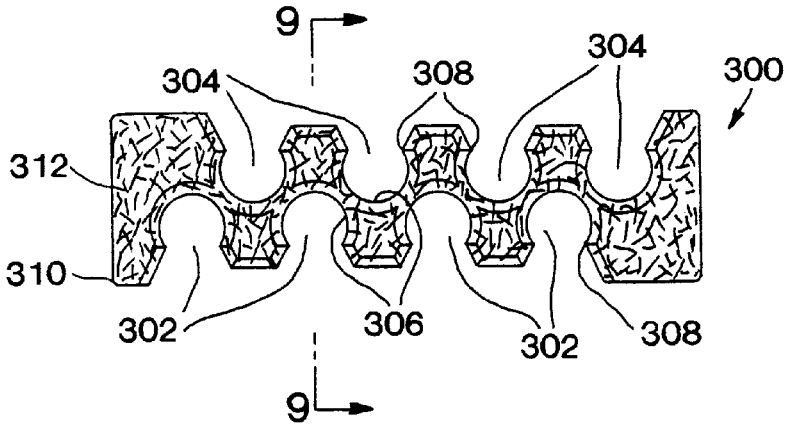
FIG. 8 is an end view of the bar shown in FIG. 7.
Figure 9:
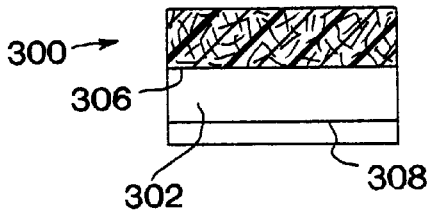
FIG. 9 is a sectional view taken along line 9—9 of FIG. 8.

FIGS. 7–9 illustrate a second embodiment cross-talk reducing bar 300 which is similar to previously described bar 42. Bar 300 has a generally rectangular block shape adapted to be seated in the front end of a cable recess in the body of a modular plug, like recess 28 of plug body 14. Body 300 includes four spaced open wire passages or slots 302 extending across the width of the body and opening toward the bottom of the body. The bar also includes four spaced open passages or slots 304 extending across the width of the body and opening on the top of the body. Slots 304 are staggered across the body from slots 302. Each slot includes a partial cylindrical bottom portion 306 and a reduced width mouth 308 having a width less than the diameter of bottom portion 306. The bottoms 306 of slot 302 and 304 have the same diameters as closed wire passages 60 in bar 44. The minimum spacing between adjacent wire retaining bottom portions 306 is 0.013 inches.

Cross-talk reducing bar or member 300 is molded from the same carbon fiber rod filled thermoplastic resin used to manufacture bar 44. The bar includes a dielectric plastic body 310 which surrounds an internal irregular three dimensional lattice made up of a large number of straight carbon fiber rods 312. The lattice is distributed essentially uniformly throughout body 310, as previously described.

Bar 300 is mounted on eight fanned insulated wires 314 extending outwardly from one end of signal transmission cable 316, as illustrated in FIG. 7. The wires are snapped past reduced Width mouth 308 and into the bottoms 306 of slots 302 and 304. With bar 300 mounted on wires 314, the ends of the wires extend forwardly past the bar. The cable and bar is then inserted into the dielectric body of a modular plug, like body, 14 previously described, with the ends of the wires 314 extended into appropriate wire passages in the plug body and with bar 300 seated in the cable recess of the body adjacent the front wall of the recess.

In bar 300 the lattice in body 310 nearly completely surrounds the parallel runs of the wires in the slots 302 and 304. The lattice absorbs cross-talk from the parallel runs of the wires. The cross-talk is absorbed on the lattice and dissipated on the lattice. The bar is not grounded.

Figure 11:
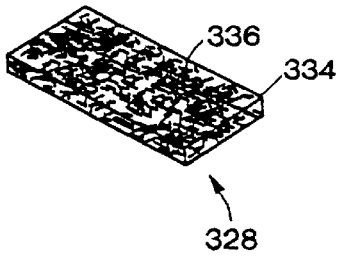
FIG. 11 is a perspective view of the bar.
Figure 12:
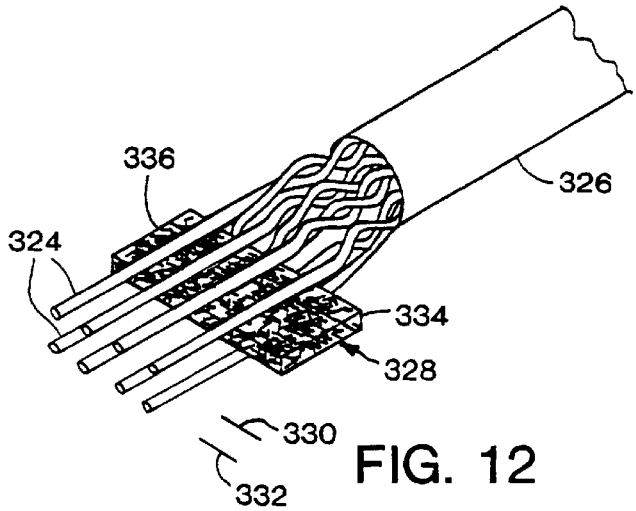
FIG. 12 is a view illustrating the bar of FIG. 11 mounted on wires extending from one end of a cable.
Figure 10:
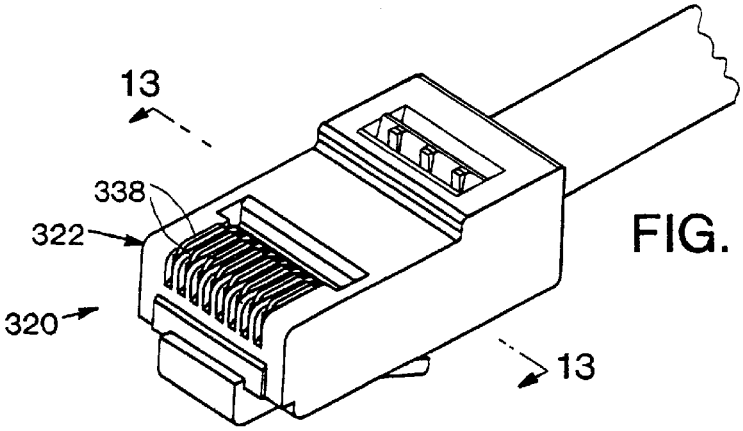
FIG. 10 is a perspective view of a third embodiment plug with a cross-talk reducing bar.
Figure 13:
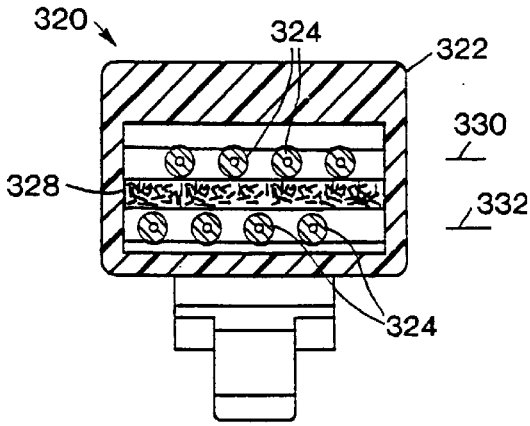
FIG. 13 is a sectional view taken along line 13—13 of FIG. 10.
Figure 15:
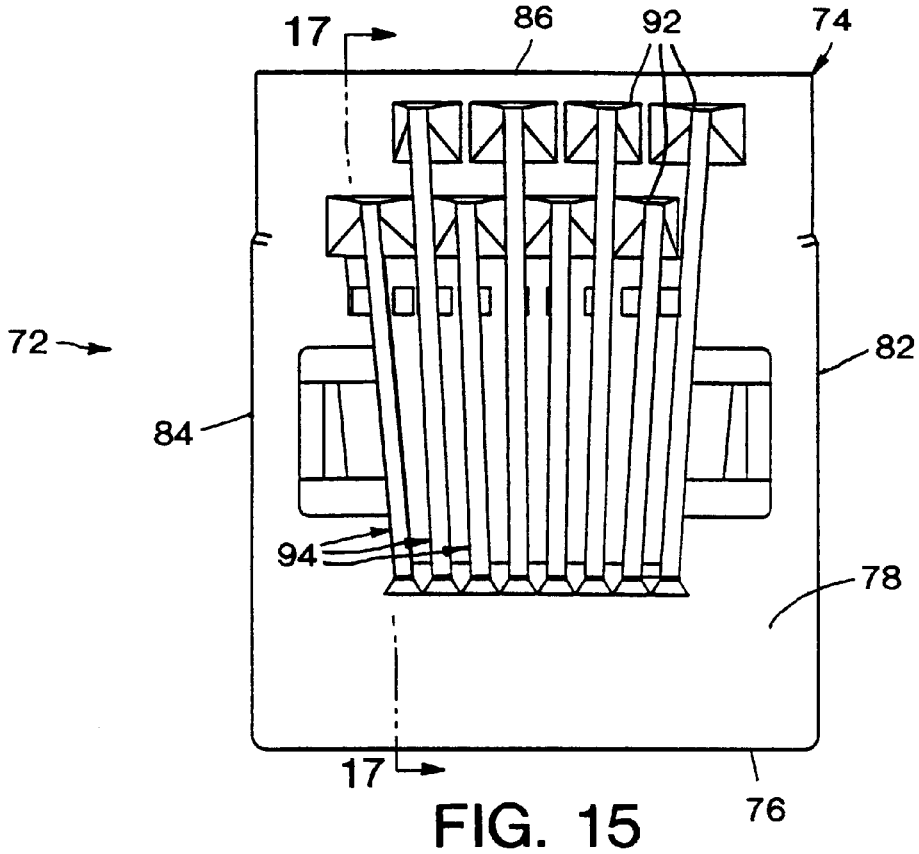
FIGS. 14, 15 and 16 are front, top and bottom views respectively of a fourth embodiment modular jack.
Figure 14:
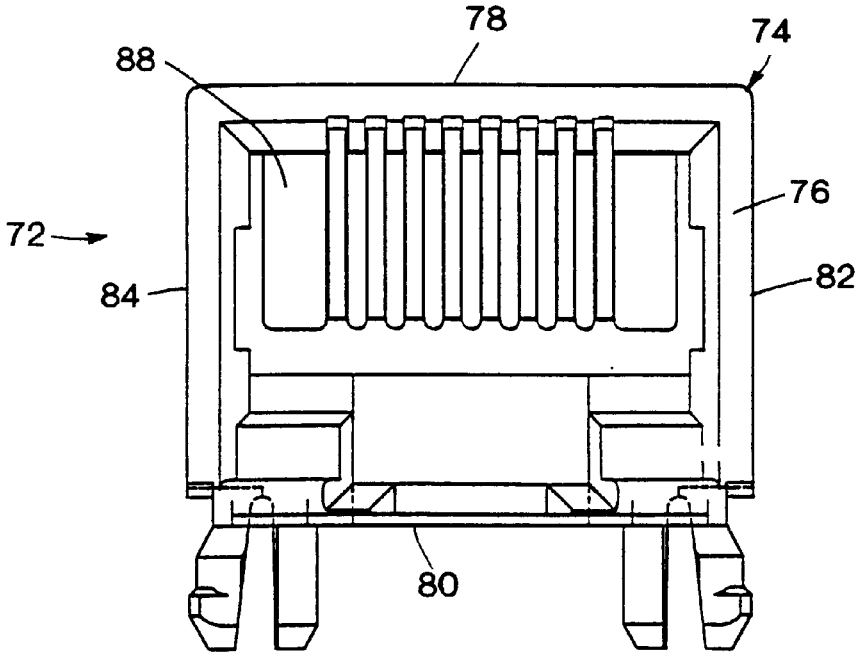
Figure 16:
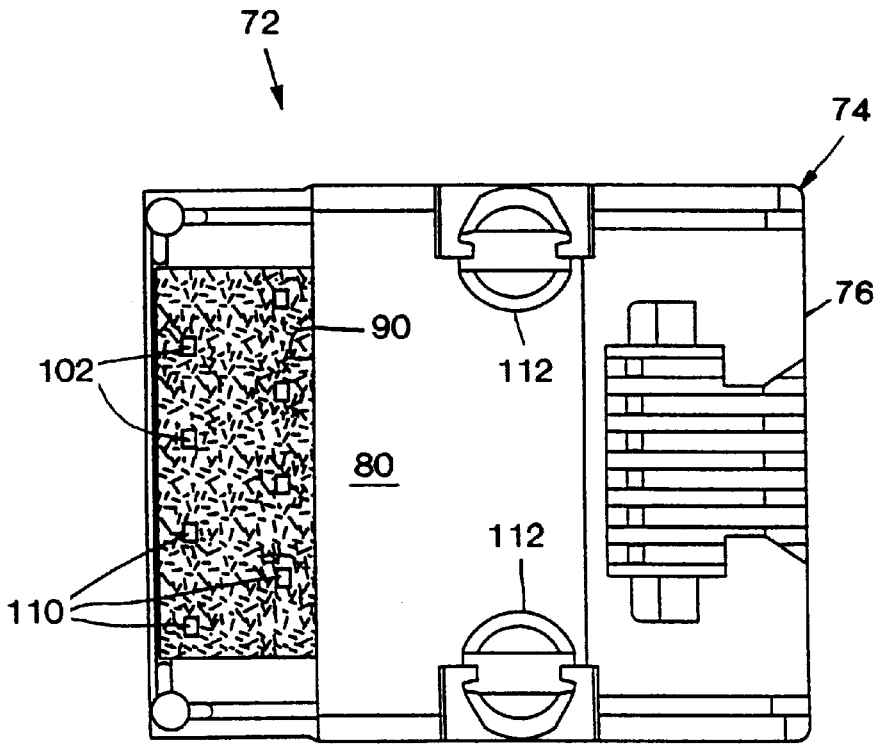

FIGS. 11–13 illustrate a modular plug 320 including a dielectric body 322 similar to plug body 14. Plug 320 is mounted on insulated wires 324 extending from the end of transmission cable 326, which is identical to cables 12 and 316. The wires 324 are untwisted and fanned as illustrated and arranged in two vertically spaced, staggered rows so that the ends of the wire are positioned for extension into the wire passages, like passages 36 in FIG. 2, in the forward end of body 322. FIG. 12 illustrates wires 324 in this position.

A rectangular cross-talk reducing bar or plate 328, shown in FIG. 11, is positioned between the two rows of staggered, parallel ends of wires 324, as shown in FIG. 12. The bar 328 absorbs cross-talk generated between wires in the upper and lower planes.

Cross-talk reducing bar or member 328 is made from the same material as the previously described bar and has a molded dielectric body 334 which surrounds a large number of small diameter straight carbon fiber rods 336 forming a conductive irregular three dimensional lattice. The lattice extends substantially uniformly throughout the body. The bar may have a thickness of 0.010 inches.

After the cable, wires and bar are inserted into body 322 blade contacts 338 are driven down through slots at the front end of the body to form electrical connections with the conductors in wires 34, as previously described.

As illustrated in FIG. 13, bar 328 is located within body 322 between the wires in the upper and lower planes 330 and 332. The conductive lattice in the bar absorbs cross-talk radiation between conductors in the two planes and dissipates the radiation in the bar. The bar is not grounded.

Figure 17:
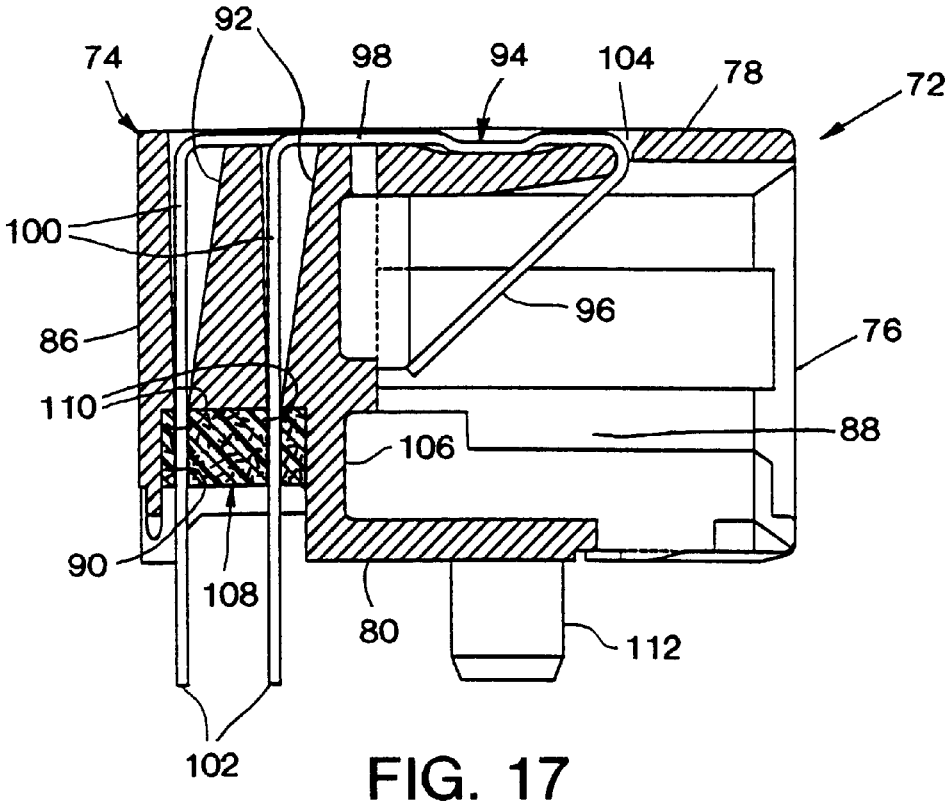
FIG. 17 is a sectional view taken along line 17—17 of FIG. 15.

FIGS. 14–17 illustrate a modular jack according to the invention adapted to mate with a modular plug to form electrical connections between the wires in a high speed transmission cable and a circuit component supporting the jack. Jack. 72 includes a one piece molded plastic dielectric body 74 having a front face 76, top side 78, bottom side 80, right side 82, left side 84 and rear face 86. Plug recess 88 is formed in front face 76 and extends into the body toward rear face 86. Bar recess 90, in body 74 is formed in bottom side 80 and extends across the width of the body between the right and left sides 82 and 84. Two rows of staggered, tapered alignment passages 92 extend downwardly from top side 78 to recess 90. Eight wire contacts 94 are mounted on body 74. Each wire contact 94 includes a cantilever contact end 96, a top portion 98 extending along top side 78 and a vertical portion 100 extending down from top side 78 through an alignment passage 92 and bar recess 90 to a contact leg 102 extending downwardly below bottom side 80. As illustrated in FIG. 17, the cantilever contact ends 96 extend through openings 104 formed in the top side of the body and into cavity 88 at an angle toward the cavity bottom 106.

Cross-talk reducing bar or member 108 is fitted in bar recess 90. Bar 108 has a rectangular block shape and includes eight contact passages 110 extending vertically through the height of the bar for receiving vertical sections 100 of contacts 94 above legs 102. Suitable insulation is provided between the contacts and bar 108 in order to electrically isolate the contacts from the bar.

Bar 108 is made from the same material as bar 44 and includes dielectric plastic body surrounding an internal irregular three dimensional conductive lattice of carbon fiber rods. The dielectric body may be formed from a suitable plastic including polycarbonate and polyester, as previously described. The percentage by weight of fibers in the body varies dependent upon the degree of cross-talk attenuation required for jack 72. A greater concentration of fibers in the bar increases cross-talk attenuation.

Dielectric body 74 includes a pair of snap latch posts 112 extending below bottom side 80 to facilitate mounting the jack on a circuit board. When mounted on the circuit board the eight contact legs 102 extend through circuit board holes and are soldered to Circuitry on the board to establish electrical connections between the contact ends 96 and circuitry on the board. When a modular plug is latched into cavity 88 of jack 72 blade contacts in the plug engage contact ends 96 in the jack to form electrical connections between cable wires and circuitry on the circuit board supporting the jack.

High frequency digital data transmissions are communicated between the cable and the circuit board through the plug and jack. The portions 100 of wire contacts 94 extending from the top side 78 to bottom side 80 and are nearly parallel to each other. Signals transmitted through these portions of the wire contacts may generate cross-talk. Generated cross-talk is attenuated by bar 108. The plug and jack each include a cross-talk attenuating bar and, when mated, cooperate to reduce cross-talk which would other wise be generated by the parallel or near parallel portions of conductors in the plug and jack.

The bar 108 surrounds short portions of the relatively long vertical contact wire sections 100. If additional cross-talk attenuation is required, the vertical depth of bar recess 90 may be increased and a correspondingly taller bar 108 may be fitted in the recess to surround a greater percentage of sections 100 and improve cross-talk attenuation.

Figure 18:
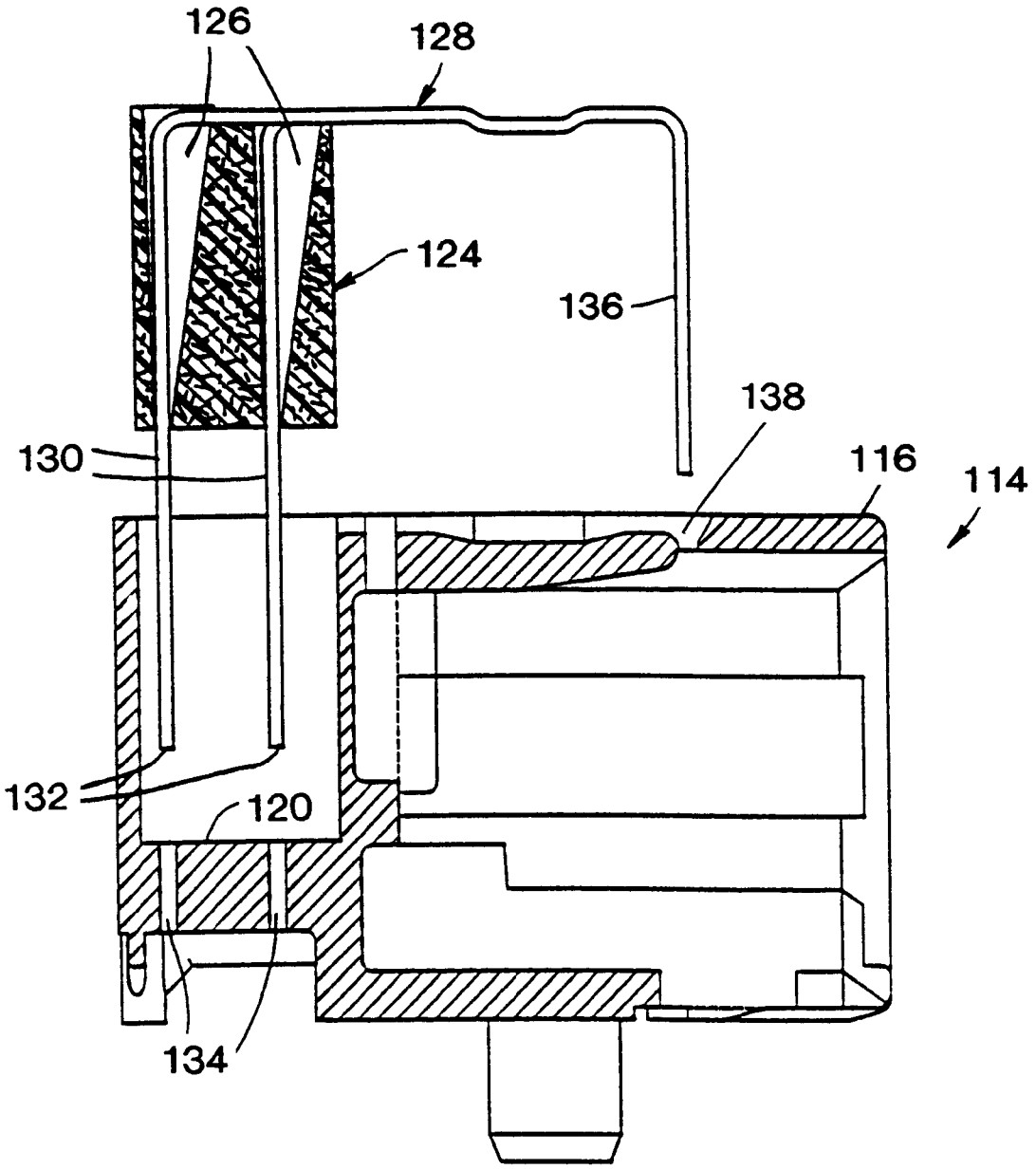
FIG. 18 is a sectional view like FIG. 17 of a fifth embodiment jack prior to assembly.
Figure 19:
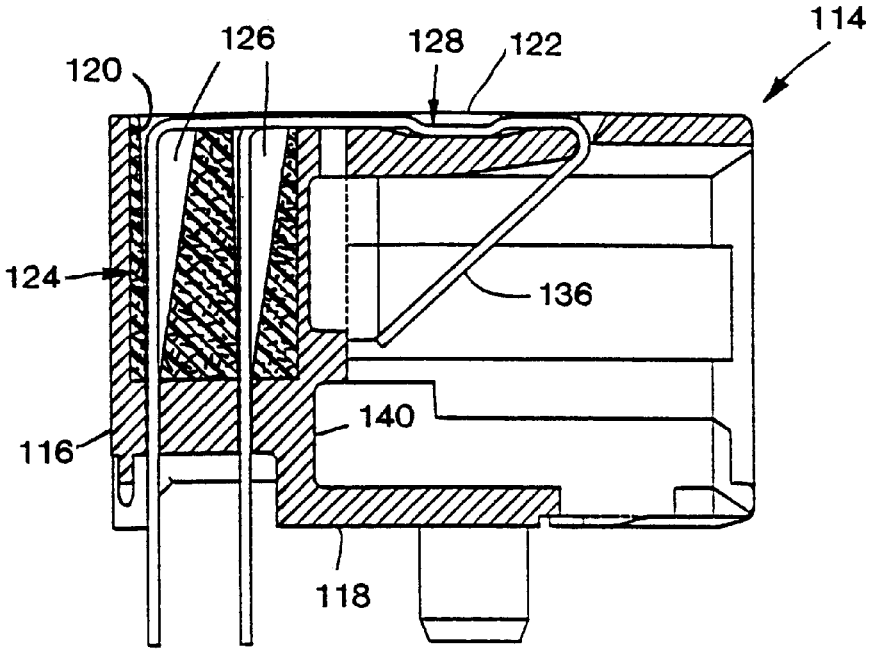
FIG. 19 is a sectional view of the jack of FIG. 18 after assembly.

FIGS. 18 and 19 illustrate another embodiment high speed modular jack 114 similar to high speed modular jack 72. Jack 114 includes a dielectric body 116 like body 74 except that the body is not provided with a bar recess opening in the bottom side 118 of the body. Body 116 is provided with a deep bar recess 120 opening into top side 122 and extending downwardly toward bottom side 118 a distance greater than one-half the height of the jack. A tall cross-talk reducing bar 124 is fitted in recess 120. The bar includes tapered alignment passages 126, like alignment passages 92 in jack 72. These passages are arraigned in the same staggered two rows as passage 96 illustrated in FIG. 15.

Modular jack 114 is assembled as shown in FIG. 18. Eight preformed wire contacts 128 are mounted on bar 124 with vertical sections 130 extended through alignment passages 126. The contacts and bar are then lowered into body 116 with the contact legs 132 extended through passages 134 in the bottom of body 116 and vertical contact ends 136 extended through openings 1138 at the top of body 16. After lowering of the bar and contacts into body 116, the contact ends 136 are bent into plug cavity 140 to complete assembly of the jack. Suitable insulation surrounds vertical sections 130 of the contact wires 128 to insulate the contact wires from bar 124.

Bar 124 is like the previously described bars and includes a molded dielectric plastic body which surrounds an irregular three dimensional conductive lattice made up of a plurality of straight conductive carbon fiber rods, as previously described. Bar 124 surrounds the major portion of each vertical contact section 130 to deduce cross-talk between conductor pairs in jack 114. The bar is not connected to other circuitry and is not grounded.

Figure 20:
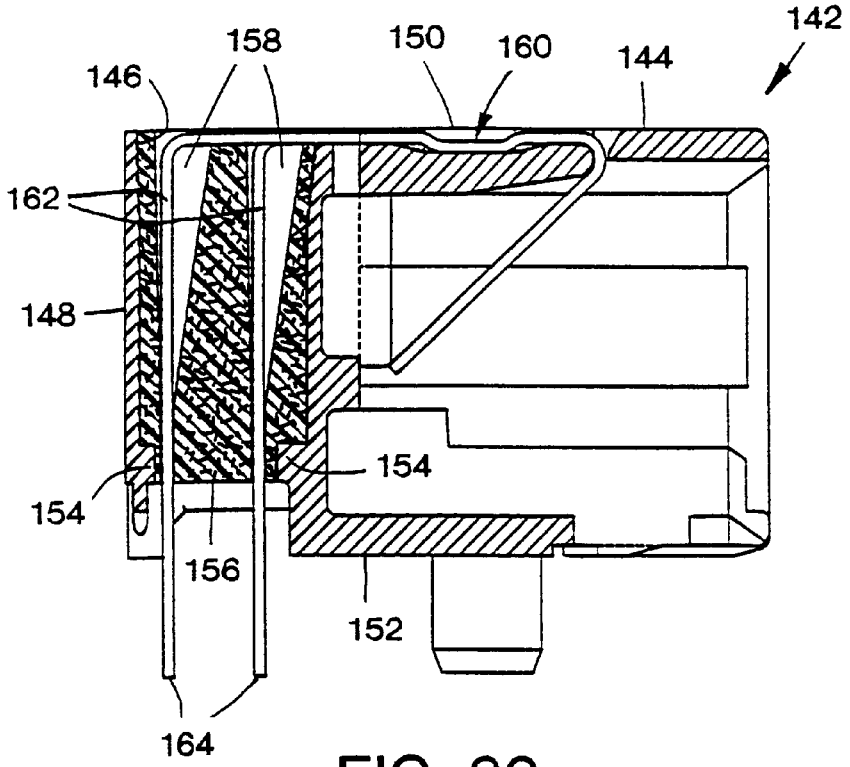
FIG. 20 is a sectional view of a sixth embodiment modular jack, similar to FIG. 19.
Figure 21:
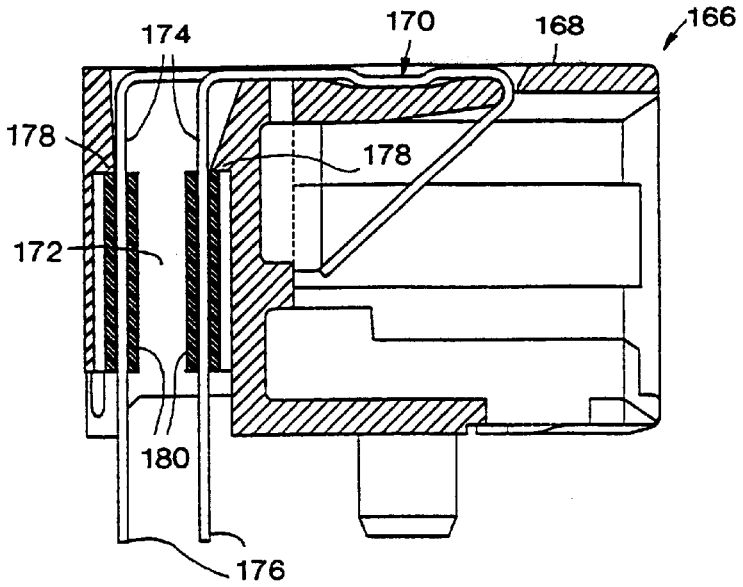
FIG. 21 is a sectional view of a seventh embodiment modular jack prior to assembly.
Figure 21:
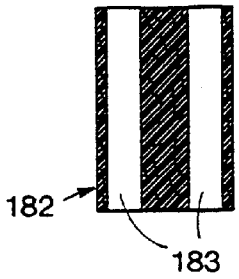

FIG. 20 illustrates a further embodiment high speed modular jack 142 similar to jack 114. Jack 142 includes a dielectric body 144 having an open ended bar recess 146 extending across rear face 148 and between top side 150 and bottom side 152. Two inward steps 154 are provided at the bottom of recess 146.

Tall cross-talk reducing bar 156 is fitted in recess 146. The bar includes eight staggered and tapered alignment passages 158 opening at the top of the bar and extending to the bottom of the bar as shown in FIG. 20. Wire contacts 160, like wire contacts 94 and 128, are mounted on body 144 and include near parallel sections 162 extending downwardly from the top side of the jack past the bottom side and forming contact legs 164. Insulation is provided to prevent wire contacts 160 from contacting conductive bar 156.

Bar 156 is like the previously described bars and includes a dielectric plastic body surrounding an irregular three dimensional conductive lattice made up of a plurality of straight conductive carbon fiber body. The bar reduces cross-talk generated between signal pairs of the wire contacts as they extend nearly parallel to each other between the top and bottom sides of the jack.

FIGS. 21–24 illustrate a high speed modular jack 166 similar to the previously described high speed modular jacks having a dielectric body 168 and a plurality of wire contacts 170 like the previously described contacts. Open ended bar recess 172 extends between the top and bottom of body 168. The wire contacts include generally vertical and nearly parallel portions 174 extending downwardly from the top of the jack to the bottom of the jack and forming contact legs 176.

Downwardly facing stop shoulders 178 are formed in recess 172 adjacent the top of the jack. Individual circumferential insulating sheaths 180 surround the wire contact portions 174 located in recess 172.

Figure 22:
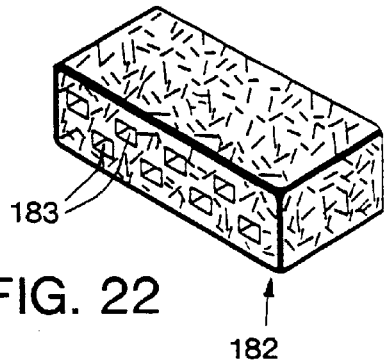
FIG. 22 is an isometric view of a cross-talk-reducing bar used in the jack of FIG. 21.
Figure 23:
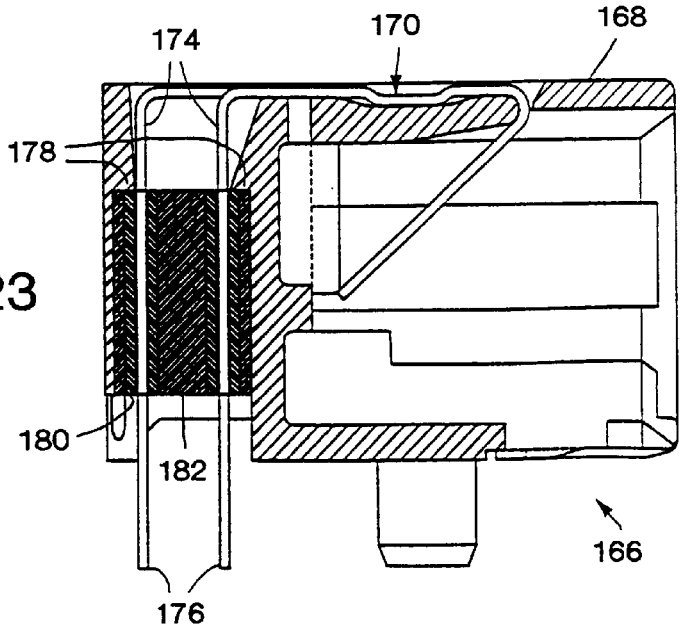
FIG. 23 is a sectional view like FIG. 21 after assembly of the modular jack.
Figure 24:
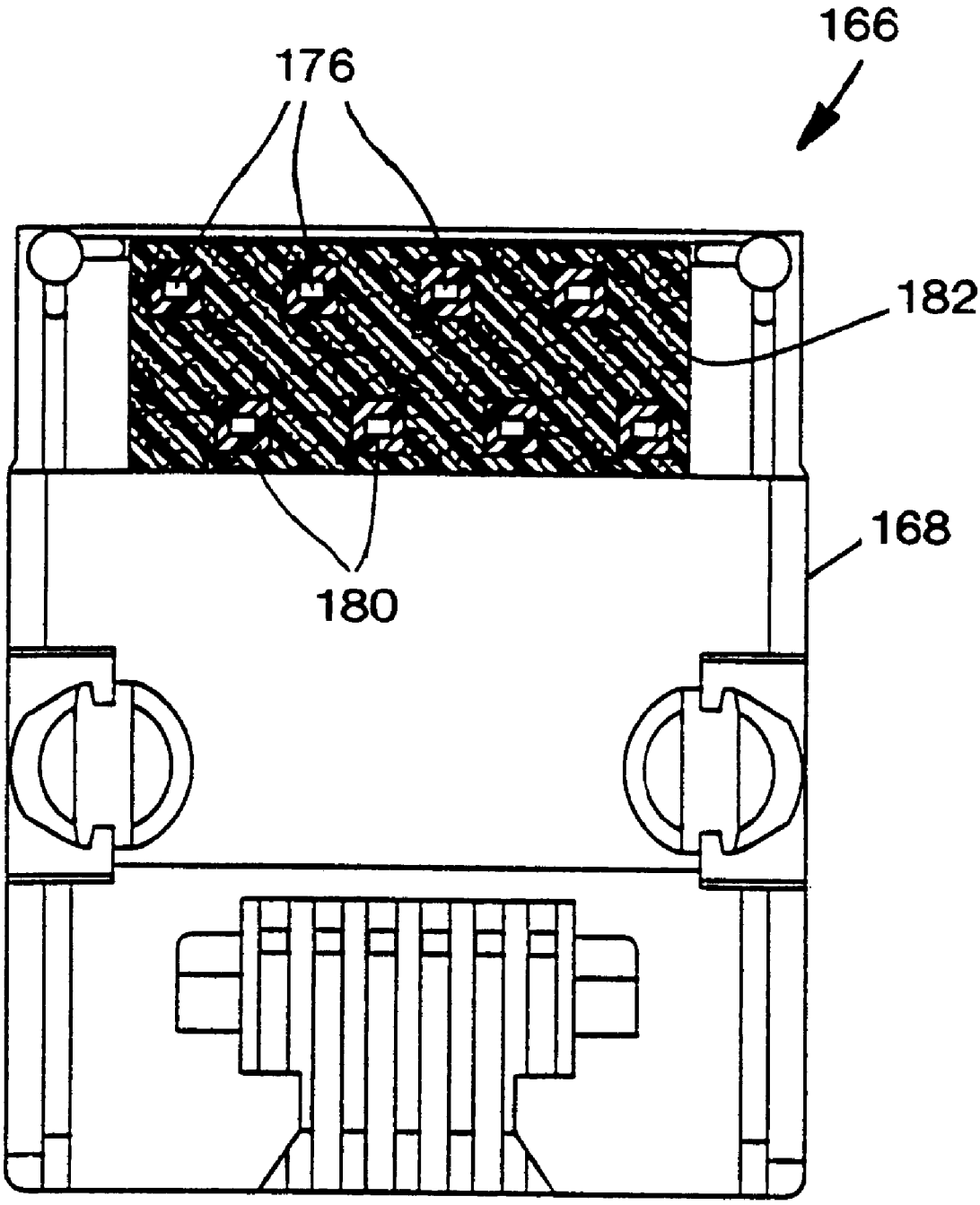
FIG. 24 is a bottom view of the jack of FIG. 23.
Figure 25:
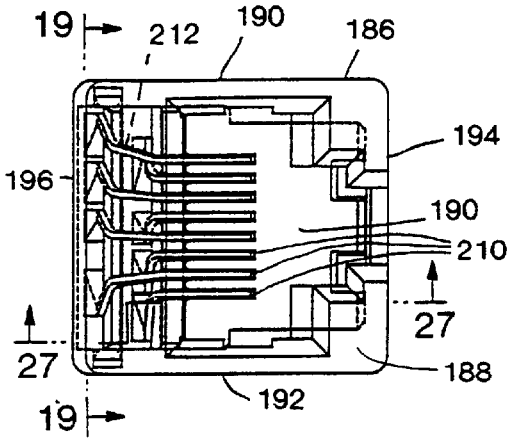
FIG. 25 is a top view of a eighth embodiment modular jack.
Figure 26:
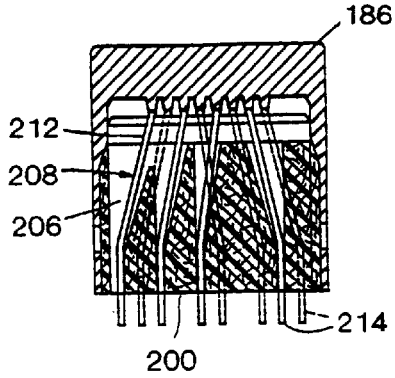
FIGS. 26 and 27 are sectional views taken, respectively, along lines 26—26 and 27—27 of FIG. 25.
Figure 27:
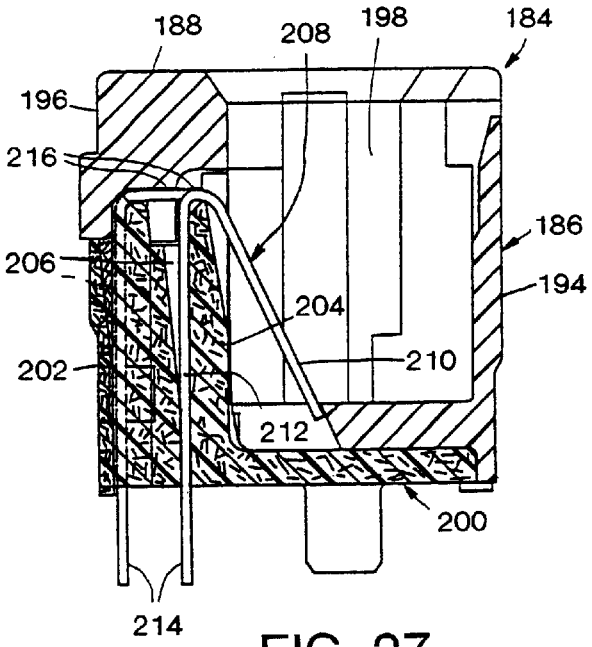

Cross-talk reducing bar 182 is rectangular in shape and includes eight through passages 183. As illustrated in FIG. 22, bar 182 has a rectangular block shape which fits snuggly within recess 172 below shoulders 178. Bar 182 is molded from dielectric plastic filled with an irregular three dimensional conductive lattice made up of a plurality of straight conductive carbon fiber rods, as previously described.

Bar 182 is inserted into recess 172 from the bottom of body 168 so that vertical portions 174 and sheaths 180 are fitted into openings 183. The sheaths electrically insulate the wire contacts from the bar. Bar 182 extends along more than half the vertical extent of contact portions 174 and reduces cross-talk between adjacent contact signal pairs, as previously described.

FIGS. 25–28 illustrate another modular jack 184 according to the invention including a molded plastic dielectric shell 186 having a top face 188, right side 190, left side 192, front face 194 and rear face 196. Vertical plug recess 198 extends downwardly into the jack from top face 188. Separate molded insert 200 is fitted into the bottom of shell 186 and includes a rear face 202 located below face 196 and recess face 204 opening into plug recess 198.

Figure 28:
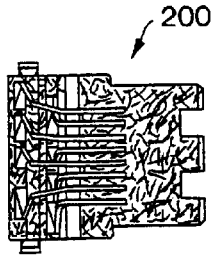
FIG. 28 is a top view of an insert used in the jack of FIGS. 25–28.

Two rows of alignment passages 206 are spaced across insert 200 between right and left sides 190 and 192. The passages are staggered and are like passages 92 of jack 72 shown in FIGS. 15 and 17. Passages 206 extend completely through insert 200 from the insert top to the insert bottom. Eight formed wire contacts 208 fire mounted in jack 184 and are spaced across the contact between the right and left sides 190 and 192. Each contact includes a cantilever contact end 210 extending from the top of the insert into the plug recess 198 at an angle, a vertical section 212 extending downwardly from the top of the insert through an alignment passage 206 and out the bottom of the insert to a solder contact leg 214 extending below the insert. The wire contacts 208 are mounted in the insert 200, as shown in FIG. 28, prior to inserting the insert and contacts into shell 186.

Insert 200 is molded from a dielectric plastic filled with elongate conductive carbon fiber rods to form an irregular three dimensional conductive lattice distributed throughout the insert, as previously described. The lattice completely surrounds the vertical sections 212 of wire contacts 208 as they extend down the rear side of jack 184 in parallel or near parallel arrangement to reduce cross-talk between adjacent signal pairs, as previously described. The wire contact vertical sections 212 and top portions 216 are insulated to prevent contact with insert 200.

Cross-talk is reduced in the disclosed modular jacks by cross-talk reducing members including conductive lattices which completely surround the wire contacts in the jacks. If desired, cross-talk reducing members with open wire contact passages or slots, like slots 302 in bar 300, may be mounted in a plug to reduce cross-talk. Additionally, flat cross-talk reducing members or bars, like bar 328, may be used in plugs between wire contacts to reduce cross-talk. Suitable insulation is provided to prevent wire contacts from contacting the cross-talk reducing bar and engaging the lattice.

The disclosed plugs and jacks meet FCC shape and contact spacing requirements. In the plugs, the blade contacts are spaced across the width of the forward end of the plugs on a center-to-center spacing of 0.04 inches, with the centers of the outer most blade contacts spaced apart 0.32 inches. Likewise, in the jacks, adjacent the cantilever contact ends have a center-to-center spacing of 0.04 inches and the center spacing of the outer two contact ends is 0.32 inches.

While the plugs and jacks disclosed herein are used for forming electrical connections between eight wire cables and computer circuitry, the invention is not limited to plugs and jacks for forming eight connections. Obviously, plugs and jacks according to the invention may be used for forming fewer than or more than eight connections, if desired.

In the disclosed plugs the insulted wires contact the cross-talk reducing members with the conductors in the wires located adjacent the cross-talk reducing members and spaced from the members by the insulation on the wires. In the plugs, the insulated wire contacts are likewise located very close to the cross talk reducing members and are separated from the members by insulation. In both cases, the insulation contacts the conductors and the cross-talk reducing members. This close arrangement increases the efficiency of the members in reducing cross talk between conductors.

While we have illustrated and described preferred embodiments of our invention, it is understood that this is capable of modification, and we therefore do not wish to be limited to the precise details set forth, but desire to avail ourselves of such changes and alterations as fall within the purview of the following claims.

What we claim as our invention:

1. A connector for reducing cross-talk, the connector comprising a connector body; a plurality of contacts mounted on the connector body, said contacts adapted to engage the contacts on a complimentary connector to establish electrical connections therewith; a plurality of conductors extending into the body, an electrical connection between each conductor and one of said contacts, portions of said conductors arraigned sufficiently close to each other to generate cross-talk; a cross-talk reducing member, said cross-talk reducing member including a dielectric body and a plurality of conductive members distributed substantially uniformly throughout the dielectric body, said conductive members contacting each other and comprising an irregular three dimensional conductive lattice, said cross-talk reducing member positioned between said cross-talk generating portions of the conductors wherein cross-talk between such conductor portions is absorbed on said lattice and dissipated along the lattice within said cross-talk reducing member; and insulation between said conductors and said cross-talk reducing member.

2. The connector as in claim 1 wherein said lattice includes a plurality of small, elongate conductive members randomly oriented within said dielectric body, said conductive members contacting each other.

3. The connector as in claim 2 wherein said conductive members comprise carbon fiber rods.

4. The connector as in claim 3 wherein the carbon fiber rods comprise from about 10 to about 35 percent by weight of the body member.

5. The connector as in claim 1 wherein said dielectric member is at least about 0.008 inches thick between conductors.

6. The connector as in claim 1 wherein said conductors contact said insulation and said insulation contacts said dielectric member.

7. The connector as in claim 1 wherein said contacts are spaced apart by about 0.04 inches and are arraigned in a row.

8. The connector as in claim 1 wherein said cross-talk reducing member includes a plurality of passages, said conductors located in said passages so that said lattice at least partially surrounds each conductor.

9. The connector as in claim 8 wherein said passages comprise slots.

10. The connector as in claim 8 wherein said passages comprise holes extending through the cross-talk reducing member and said lattice extends completely around each conductor.

11. The connector as in claim 8 wherein at least some of said passages in said cross-talk reducing member are arranged in a row.

12. The connector as in claim 8 wherein the minimum distance between adjacent conductor passages in the cross-talk reducing member is about 0.008 inches.

13. The connector as in claim 8 wherein each conductor passage has a minimum length of about 0.055 inches.

14. The connector as in claim 1 wherein said connector body is formed from molded dielectric plastic and includes a recess, said cross-talk reducing member fitted in said recess and said conductor portions extend through said recess.

15. The connector as in claim 1 wherein said connector comprises a modular plug, said connector body is formed of dielectric plastic, said contacts comprise a row of blade contacts at one end of the plug and said conductors are insulated; and including a signal-transmitting cable having a plurality of insulated wires, said conductors extending from one end of the cable, past said cross-talk reducing member and to said blade contacts.

16. The connector as in claim 15 wherein said connector body includes a recess, said cross-talk reducing member located in said recess.

17. The connector as in claim 1 wherein the connector comprises a modular jack and said connector body includes a plug recess, said conductors comprise wire contacts in said conductor body, said contacts comprise a row of cantilever ends extending into said plug recess and contact legs extending outwardly from said connector body.

18. The connector as in claim 17 wherein said conductor portions extend across the bottom of the plug recess.

19. The connector as in claim 17 wherein the conductor portions extend along one side of the plug recess.

20. The connector as in claim 1 wherein the cross-talk reducing member is not grounded.

21. A connector for reducing cross-talk, the connector comprising a dielectric modular plug body, a row of blade contacts spaced across one end of the plug body, said plug body including a recess away from said blade contacts; a signal cable having an end and a plurality of insulated conductors at the end of the cable, said conductors extending through said recess and into the plug body; electrical connections between said conductors and said blade contacts; and a cross-talk reducing member located in said recess between a number of said insulated conductors, the cross-talk reducing member including a dielectric body and a plurality of conductive members distributed substantially uniformly throughout the dielectric body, said conductive members contacting each other and comprising an irregular three-dimensional conductive lattice, wherein cross-talk between said number of conductors is absorbed on and dissipated along the lattice in said member.

22. The connector as in claim 21 wherein said lattice includes a plurality of small, elongate conductive members contacting each other.

23. The connector as in claim 22 wherein said members comprise carbon fiber rods.

24. The connector as in claim 21 wherein said insulated conductors touch said members.

25. The connector as in claim 21 wherein said cross-talk reducing member comprises a bar and including passages in the bar, said insulated conductors located in said passages.

26. The connector as in claim 25 wherein the minimum distance between adjacent passages is at least about 0.008 inches.

27. The connector as in claim 21 wherein said passages are slots.

28. The connector as in claim 21 wherein said blade contacts are spaced apart about 0.04 inches.

29. The connector as in claim 21, wherein said member comprises a plate.

30. The connector as in claim 27 wherein said cross-talk reducing member includes a collar substantially surrounding said insulated conductors, said lattice extending into said collar.

31. The connector as in claim 21 wherein the cross-talk reducing member is not grounded.

32. A modular jack for reducing cross-talk, the jack comprising a jack body defining a plug recess; a plurality of wire contacts in the jack body, said contacts including a row of cantilever contact ends extending into the plug recess, a plurality of contact legs extending outwardly from said jack body for forming electrical connections with circuit members and conductor portions extending between said cantilever contacts and said contact legs, the conductor portions sufficiently close to each other to generate cross-talk; a cross-talk reducing member positioned between cross-talk generating conductor portions, said cross-talk reducing member including a dielectric body and a plurality of conductive members, distributed uniformly throughout the dielectric body, said conductive members contacting each other and comprising an irregular three-dimensional conductive lattice; and insulation between the lattice and the conductive portions, wherein cross-talk between conductor portions is absorbed on and dissipated along said lattice.

33. The modular jack as in claim 32 wherein said cross-talk reducing member is not grounded.

34. The modular jack as in claim 32 wherein said conductive members comprise carbon fiber rods.

35. The modular jack as in claim 32 wherein said cross-talk reducing member includes a number of passages and a conductor portion is located in each such passage so that the lattice at least partially surrounds each conductor portion.

36. The modular jack as in claim 35 wherein each passage and the lattice completely surrounds each conductor portion.

37. An electrical connector system for reducing cross-talk, the system including a plurality of elongate conductors each having an end, said ends located adjacent to each other for forming electrical connections with contact members; a cross-talk reducing member including a dielectric body and a plurality of conductive members distributed substantially uniformly throughout the dielectric body, said conductive members contacting each other and comprising an irregular three-dimensional conductive lattice, said cross-talk reducing member positioned between a number of said elongate conductors; and insulation separating said elongate conductors from the lattice in said cross-talk reducing member, wherein cross-talk between such elongate conductors is absorbed on and dissipated along the lattice within the cross-talk reducing member.

38. The connector as in claim 37 wherein the cross-talk reducing member is not grounded.

39. The system as in claim 37 wherein said cross-talk reducing member includes a plurality of passages, said elongate conductors located in said passages.

40. The system as in claim 37 wherein said lattice completely surrounds said elongate conductors.

* * * * *

UNITED STATES PATENT AND TRADEMARK OFFICE

CERTIFICATE OF CORRECTION

PATENT NO. : 6,579,116 B2
DATED : June 17, 2003
INVENTOR(S) : Brennan et al.

It is certified that error appears in the above-identified patent and that said Letters Patent is hereby corrected as shown below:

Column 4,
Line 25, replace “Which” with -- which --.

Column 9,
Line 23, replace “1138” with -- 138 --.
Line 34, replace “deduce” with -- reduce --.

Signed and Sealed this

Seventh Day of October, 2003

JAMES E. ROGAN
*Director of the United States Patent and Trademark Office*